US008430187B2

(12) United States Patent
Hearn

(10) Patent No.: US 8,430,187 B2
(45) Date of Patent: Apr. 30, 2013

(54) DIRECTIONAL SIDETRACK WELL DRILLING SYSTEM

(75) Inventor: David D. Hearn, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 199 days.

(21) Appl. No.: 12/708,266

(22) Filed: Feb. 18, 2010

(65) Prior Publication Data

US 2010/0218996 A1 Sep. 2, 2010

Related U.S. Application Data

(60) Provisional application No. 61/156,171, filed on Feb. 27, 2009.

(51) Int. Cl.
*E21B 7/08* (2006.01)
*E21B 10/00* (2006.01)

(52) U.S. Cl.
USPC ..... 175/61; 175/75; 175/376; 175/398; 166/52; 166/117.5; 166/313

(58) Field of Classification Search ..... 175/61, 175/73, 75, 344, 376, 385, 398, 399; 166/52, 166/117.5, 313
See application file for complete search history.

(56) References Cited

U.S. PATENT DOCUMENTS 2,882,015 A * 4/1959 Beck ..... 166/55.3
3,330,349 A * 7/1967 Owsley et al. ..... 166/285
4,182,423 A * 1/1980 Ziebarth et al. ..... 175/61
4,420,049 A * 12/1983 Holbert ..... 175/45
4,605,076 A * 8/1986 Goodhart ..... 175/61
5,115,872 A * 5/1992 Brunet et al. ..... 175/61
5,318,121 A * 6/1994 Brockman et al. ..... 166/313
5,325,924 A 7/1994 Bangert et al.
5,415,238 A 5/1995 Nice
5,439,051 A 8/1995 Kennedy et al.
5,458,209 A * 10/1995 Hayes et al. ..... 175/61
5,544,704 A * 8/1996 Laurel et al. ..... 166/117.6
5,575,343 A 11/1996 Gray
5,704,437 A * 1/1998 Murray ..... 175/61
5,806,600 A * 9/1998 Halford, Sr. ..... 166/382
5,806,614 A * 9/1998 Nelson ..... 175/61

(Continued)

FOREIGN PATENT DOCUMENTS

EP 1626159 7/2006

OTHER PUBLICATIONS

"Pursuing opportunities", North Sea Pioneer, Jul. 2005.

(Continued)

*Primary Examiner* — Jennifer H Gay
(74) *Attorney, Agent, or Firm* — ConocoPhillips Company

(57) ABSTRACT

Drilling a sidetrack wellbore out of the side of an existing wellbore utilizing a drillable billet having a path formed in the billet to lead a bi-centered drillbit to kick-out from the wellbore and form a sidetrack wellbore. The bi-centered bit is arranged for the lands of the pilot section to follow the path of the billet while the wings of the ream out a portion of the billet and also ream out the earth to form the full dimension sidetrack wellbore. The bi-centered bit is used to drill the sidetrack wellbore to the target zone so that the entire drilling process extends from the existing wellbore to the target zone without a mandatory withdrawal of the drillstring from the wellbore.

14 Claims, 7 Drawing Sheets

U.S. PATENT DOCUMENTS

| | | | | |
|---|---|---|---|---|
| 5,934,383 | A | 8/1999 | Jurgens et al. | |
| 6,003,621 | A * | 12/1999 | Murray | 175/79 |
| 6,073,697 | A * | 6/2000 | Parlin et al. | 166/313 |
| 6,116,356 | A * | 9/2000 | Doster et al. | 175/75 |
| 6,332,498 | B1 * | 12/2001 | George | 166/50 |
| 6,334,485 | B1 * | 1/2002 | George | 166/50 |
| 6,374,924 | B1 * | 4/2002 | Hanton et al. | 175/6 |
| 6,419,021 | B1 * | 7/2002 | George et al. | 166/313 |
| RE37,867 | E | 10/2002 | Gondouin | |
| 6,550,550 | B2 * | 4/2003 | Hanton et al. | 175/61 |
| 6,561,289 | B2 | 5/2003 | Portman et al. | |
| 6,659,207 | B2 * | 12/2003 | Hoffmaster et al. | 175/391 |
| 6,712,144 | B2 * | 3/2004 | Buytaert | 166/313 |
| 6,761,217 | B1 * | 7/2004 | McGarian | 166/255.3 |
| 6,913,098 | B2 * | 7/2005 | Fielder et al. | 175/385 |
| 6,915,847 | B2 * | 7/2005 | Brockman | 166/250.08 |
| 7,066,284 | B2 | 6/2006 | Wylie et al. | |
| 7,077,206 | B2 * | 7/2006 | Kennedy et al. | 166/313 |
| 7,178,589 | B2 * | 2/2007 | Campbell et al. | 166/216 |
| 7,357,182 | B2 * | 4/2008 | Hunt et al. | 166/298 |
| 7,373,984 | B2 * | 5/2008 | Pratt et al. | 166/313 |
| 7,401,665 | B2 | 7/2008 | Guerrero et al. | |
| 7,669,664 | B2 * | 3/2010 | McGarian et al. | 166/382 |
| 7,753,139 | B2 * | 7/2010 | Dewey et al. | 175/61 |
| 8,069,920 | B2 * | 12/2011 | Cronley et al. | 166/255.3 |
| 2002/0023754 | A1 * | 2/2002 | Buytaert | 166/313 |
| 2002/0056572 | A1 * | 5/2002 | Hanton et al. | 175/73 |
| 2002/0162690 | A1 * | 11/2002 | Hanton et al. | 175/73 |
| 2003/0010533 | A1 * | 1/2003 | Hart et al. | 175/61 |
| 2003/0098152 | A1 * | 5/2003 | Kennedy et al. | 166/117.6 |
| 2005/0133268 | A1 * | 6/2005 | Moriarty | 175/61 |
| 2007/0007000 | A1 * | 1/2007 | Dewey et al. | 166/55.7 |
| 2007/0007043 | A1 * | 1/2007 | Dewey et al. | 175/75 |
| 2009/0194292 | A1 * | 8/2009 | Oglesby | 166/369 |
| 2010/0065282 | A1 * | 3/2010 | Clark et al. | 166/376 |
| 2010/0218996 | A1 * | 9/2010 | Hearn | 175/61 |
| 2010/0218997 | A1 * | 9/2010 | Dewey et al. | 175/61 |
| 2010/0307736 | A1 * | 12/2010 | Hearn et al. | 166/117.5 |
| 2011/0011646 | A1 * | 1/2011 | Giroux et al. | 175/61 |
| 2011/0155468 | A1 * | 6/2011 | Gregurek et al. | 175/61 |

OTHER PUBLICATIONS

"Drilling & Production: Slimhole tools offer drilling, completion options", Oil & Gas Journal, Nov. 28, 2005.

"Coiled Tubing Reaches for Areas of Growth" PTTC Network News, 2nd Quarter 2002.

* cited by examiner

DIRECTIONAL SIDETRACK WELL DRILLING SYSTEM

CROSS-REFERENCE TO RELATED APPLICATIONS

This application is a non-provisional application which claims benefit under 35 USC §119(e) to U.S. Provisional Application Ser. No. 61/156,171 filed Feb. 27, 2009, entitled "Directional Sidetrack Drilling System," which is incorporated herein in its entirety.

STATEMENT REGARDING FEDERALLY SPONSORED RESEARCH OR DEVELOPMENT

None

FIELD OF THE INVENTION

This invention relates to drilling wells for producing fluids such as oil and gas.

BACKGROUND OF THE INVENTION

In the process of drilling oil and gas wells, it is common to want to steer the drillbit to get the well to a desired location that is likely to have hydrocarbons trapped. While many technologies have been developed to steer the drillbit, there are many forces that resist or prevent steering. For example, when it is desired to sidetrack from an existing wellbore at some distance from the bottom of the existing wellbore, the least resistant path for the drillbit to follow is along the existing wellbore. It is a challenge to get a drillbit to bite into the side of an existing wellbore without something to push against.

To overcome the tendency of drillbits to follow existing wellbores, the conventional technique is to create a cement plug in the location where it is desired to side track out from the existing wellbore. However, the cement plug closes the existing wellbore and further production in the original wellbore below the location of the sidetrack well is blocked.

Other efforts to provide some resistance to use for creating a sidetrack wellbore include inserting an aluminum plug. The aluminum plug is more easily installed or at least less time consuming than a cement plug, but the aluminum plug tends to be kind of sloppy in the wellbore in that when the side track goes down from a somewhat horizontal well, the plug is likely to fall down into the hole when the drill string is pulled out of the side track and therefore block the side track.

Also, it should be recognized that the relative density or resistance of the formation to drilling is likely to be different than the density or resistance to the drillbit of either the cement or aluminum plug. As such, there is still some concern about the drillbit getting out of the original wellbore and being able to drill to the target formation without having too much curvature or "dogleg". For example, it might be attractive to use a drill motor having an aggressive angle to make sure that the drillbit fully exits the existing wellbore before the end of the plug is reached. However, the aggressive angle may be less preferred if the target formation is a considerable distance from the original wellbore. A wellbore that snakes and twists too much will create too much friction when liner or casing is inserted into the side track wellbore. So, the sidetrack might be created initially with a higher angle motor, recognizing that the most severe angles for well drilling are very small (less than four degrees off center, for example) but replaced with a motor that has a much smaller angle that will reach the target with a straighter wellbore. This strategy requires two "trips" where the drillstring is withdrawn from the wellbore and re-inserted. Trips are noteworthy from a financial standpoint as it sometimes takes quite a bit of time to pull out thousands of feet of a drillstring and then re-insert the drillstring to the same point and time is money on a drilling rig.

SUMMARY OF THE INVENTION

The present invention relates to a process for drilling a sidetrack wellbore out of the side of an existing wellbore above the bottom of the existing wellbore where a drillable billet is installed into an existing wellbore at a desired location for stepping out of the wellbore and beginning the sidetrack wellbore. The drillable billet is made of a drillable material and has a long, generally cylindrical body that is suited and sized for insertion into the existing wellbore and block the wellbore below the location of the billet. A path is formed in the billet and is arranged to direct anything descending down the wellbore to a preferred side of the wellbore. A drillstring with a bi-centered drillbit is lowered into the existing wellbore down to the location of the billet where the bi-centered drillbit includes a pilot drill portion suited for drilling into the earth and for following the path in the billet. The bi-centered drillbit also includes at least one wing portion extending radially outwardly from the pilot drill portion suited for reaming out a hole larger than the pilot drill portion. The bi-centered drillbit is rotated so as to direct the drillbit so that the pilot drill portion follows the path and the wing portion reams out at least part of the billet and also into the earth to form a sidetrack well through the side wall of the existing wellbore into the earth.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Turning now to the preferred arrangement for the present invention, reference is made to the drawings to enable a more clear understanding of the invention. However, it is to be understood that the inventive features and concept may be manifested in other arrangements and that the scope of the invention is not limited to the embodiments described or illustrated. The scope of the invention is intended only to be limited by the scope of the claims that follow.

Figure 1:
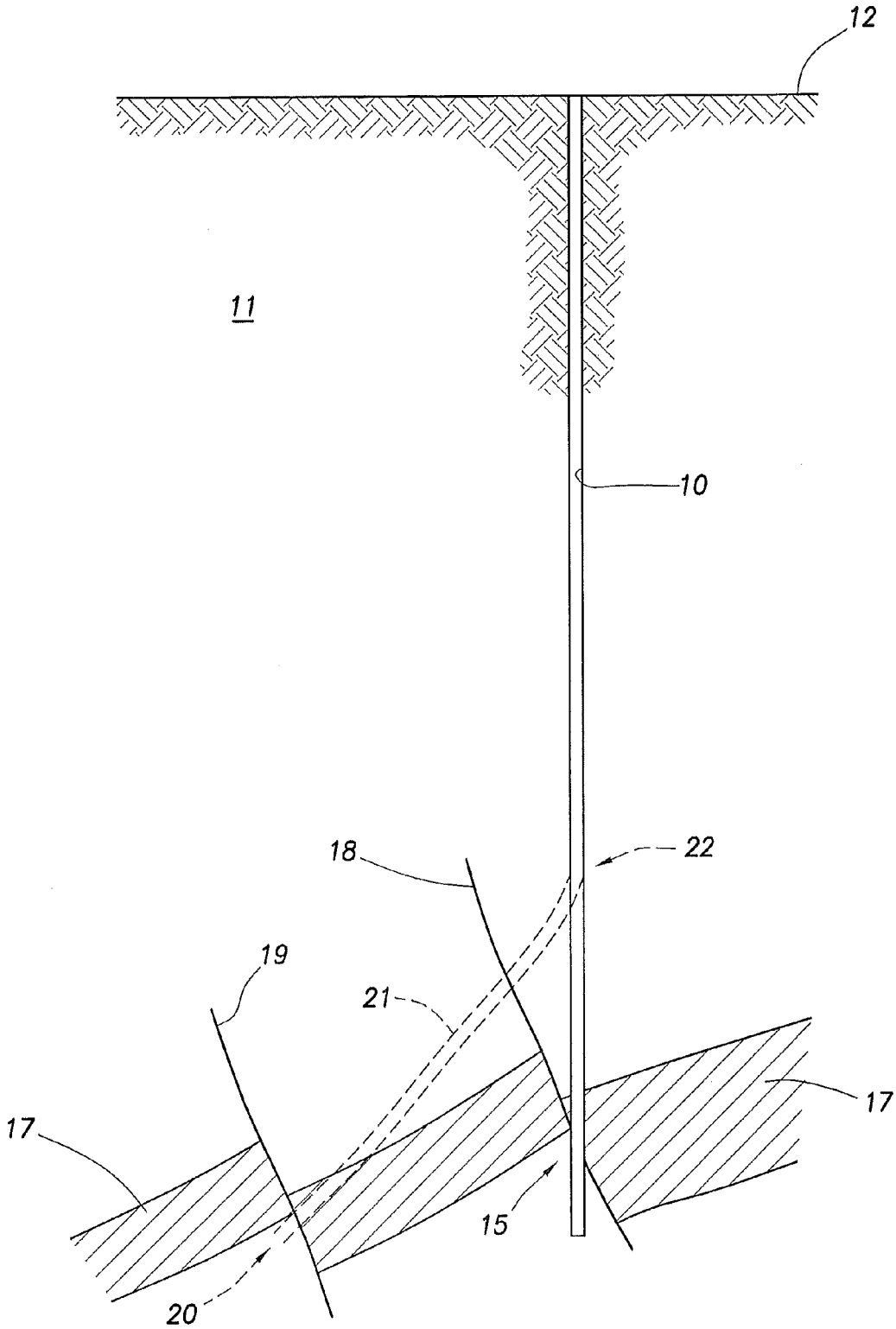
FIG. 1 is a vertical and fragmentary cross sectional view of a not to scale wellbore used for the production of hydrocarbons from an earthen formation.

Turning to FIG. 1, a wellbore 10 is shown to be formed deep into the earth 11 from surface 12. Within the earth 11 are layers of various materials. Some of the layers are porous and other layers are less porous or impermeable. Oil and gas tend to migrate through porous layers until they are trapped by impermeable or much less permeable formations. These traps may be targets for finding oil and gas in economic quantities.

It is not uncommon for a number of potential traps to be within a few hundred yards of other traps. It is very desirable to access these traps from a common wellbore or access a new trap through an existing wellbore that is thousands of feet deep but only a few hundred of feet away from the untapped deposit. It is very desirable to be able to produce fluids from several of these traps at the same time through a common wellbore. As shown in FIG. 1, wellbore 10 is shown to have tapped target formation 15. In this illustration, target formation is a trap created by a low permeability layer 17 and fault line 18 at which the layer 17 has been split and shifted or offset to create trap 15 where hydrocarbons may accumulate in a porous hydrocarbon bearing zone below layer 17. An untapped second target formation 20 is similarly shown to be created by the same layer 17 that is split and shifted along second fault line 19. The second target formation 20 should also be seen to be closer to wellbore 10 than it is to surface 12. One should understand that FIG. 1 is not to scale as the target formations are often many thousands of feet below the surface and can be offset above, below and to either side of another target by a broad range of distances. What a reader should understand is that when it is practical to use an already drilled borehole such as wellbore 10, it may be very efficient to drill a sidetrack wellbore such as 21 that uses a significant portion of the existing borehole, but kicks out from a location substantially above the bottom end of wellbore 10. Specifically, the sidetrack wellbore 21 is intended to begin at about location 22. It should also be understood that this illustration is not intended to describe in detail the geology of hydrocarbon traps, but only to set forth a simple and understandable explanation as to why one would have drilled an existing well and then modify that well to go after a separate but nearby zone.

Figure 2:
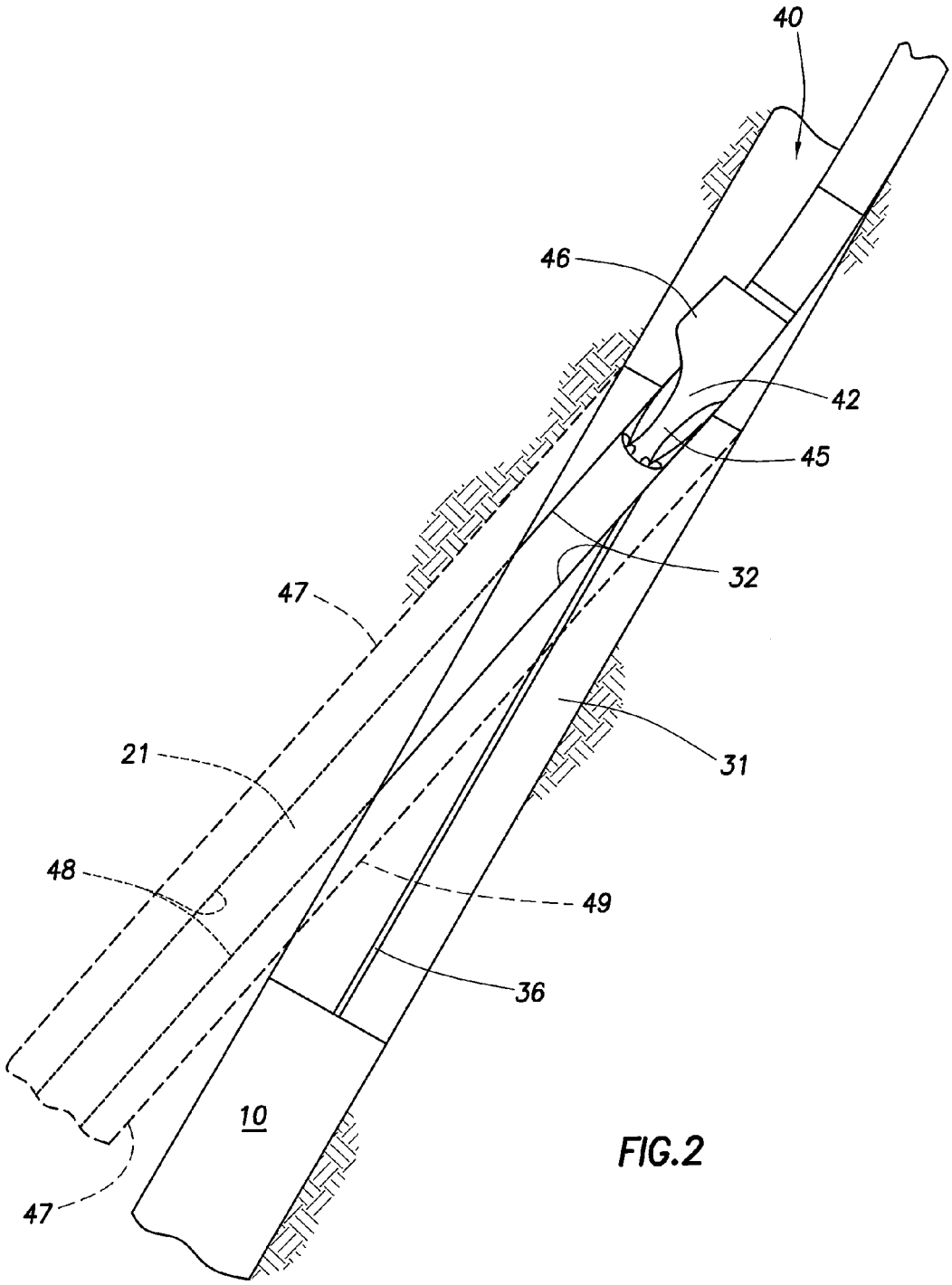
FIG. 2 is a close up vertical and fragmentary cross sectional view of a not to scale drillstring and billet in a wellbore showing the inventive process of drilling a sidetrack wellbore.

So, referring now to FIG. 2, a billet 31 is installed in the wellbore 10 at the location 22. The billet 31 may be installed along with a liner or casing string extending down to the first target zone 15 for use in producing fluids from the first target zone 15. The billet 31 is a relatively long cylindrically shaped piece of aluminum or similar material that is substantial enough to be fixed in place and holds up to rough treatment including rotating drill bits while at the same time being soft enough to accommodate portions of the billet being drilled away. As such, the billet 31 is sometimes referred to as drillable. Preferably, the billet 31 includes an axial port 36 to allow fluids to flow past the billet and be produced to the surface. Other openings and channels in the exterior walls may be created to facilitate the installation process of the billet 31 in the wellbore and the passage of desired fluids to the surface 12.

Figure 3:
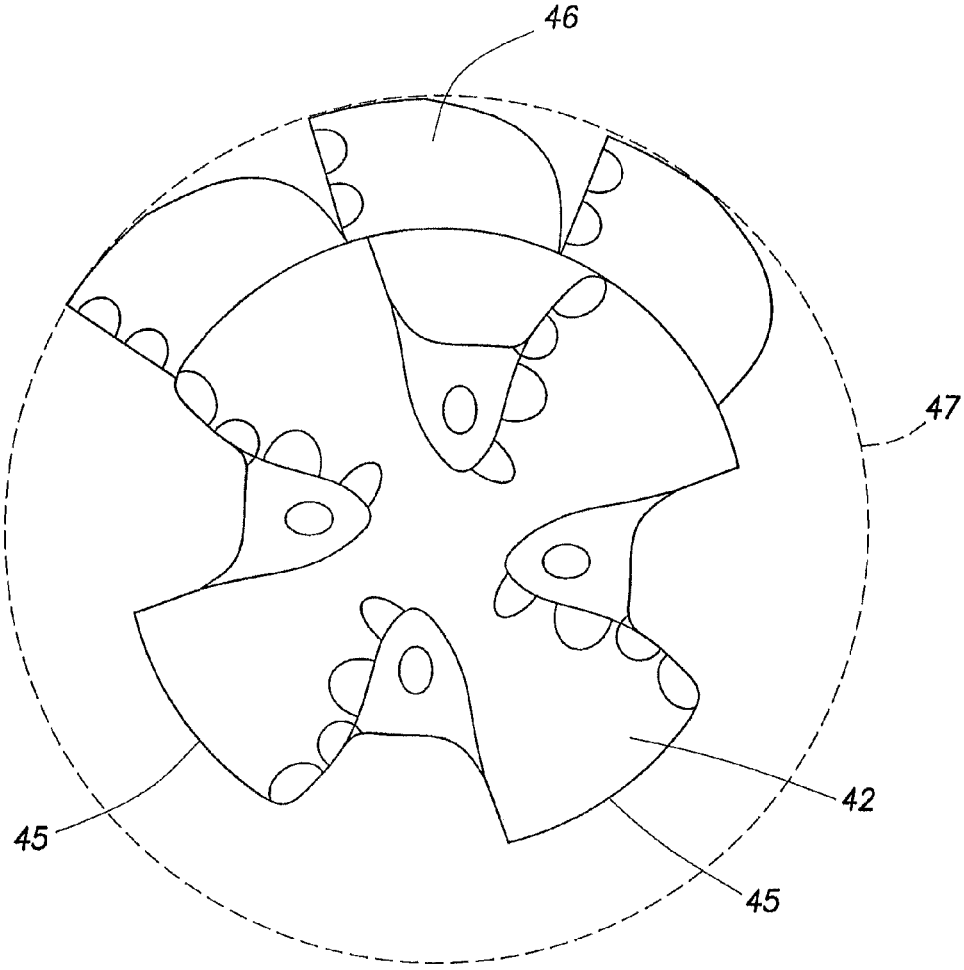
FIG. 3 is an end view of a bi-centered drillbit for use in drilling boreholes and that is suitable for use in the inventive procedure of the present invention.
Figure 4:
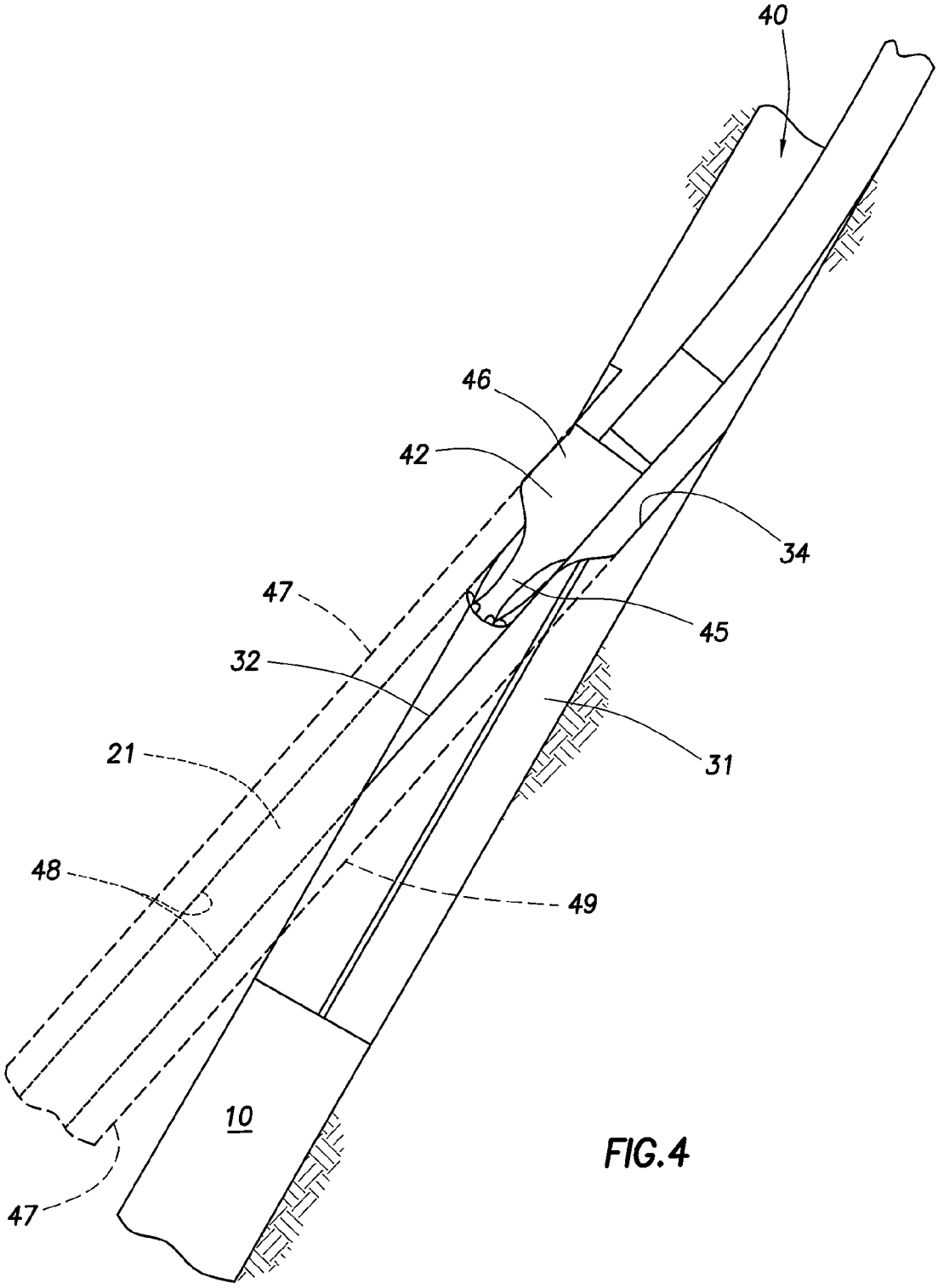
FIG. 4 is a close up vertical and fragmentary cross sectional view of a not to scale drillstring and billet in a wellbore similar to FIG. 2 with the drillbit having progressed further into the sidetrack wellbore.

The billet 31, also includes a path 32 that is preferably formed at the center or at the axis of the top end of the billet 31. It should be understood that there may be circumstances where the path may start at a location that is off center from the axis of the billet. For simplicity, a path 32 that begins near the center of the top end of the billet or near the axis of the billet will be assumed and described. The path 32 is oriented to extend in a direction that deviates from the axis and leads to the periphery of the billet 31 whether by a curved path or by a straight path that is at an angle relative to the axis of the billet 31. With the billet 31 installed in the wellbore 10, a drillstring, generally indicated by the number 40 is inserted into the wellbore to engage billet 31. At the bottom end of drillstring 40 is a bi-centered drill bit 42. Referring to now to FIGS. 2, 3 and 4, a bi-centered drill bit is a known type of drill bit that is designed to drill boreholes larger in diameter than the actual lateral dimension of the drill bit. Focusing on FIG. 2, a bi-centered drill bit includes a pilot portion at the tip which includes cutting surfaces at the tip end and several lands 45 that are designed to follow the path 32 in the billet 31. The diameter of the path 32 is preferably about the same diameter of the pilot portion of the drill bit 42 to provide stability to the drillstring as the drill bit 42 rotates with the pilot portion in the path 32. The pilot portion comprises about half the length of the drill bit 42. Wings 46, which three are shown in FIG. 3, is a portion of the drill bit 42 which is arranged to extend radially beyond the diameter formed by the lands 45 and ream out a larger diameter borehole. Since the wings 46 are positioned along a segment comprising about one quarter of the circumference of the drill bit 42, the drill bit 42 actually drills a hole indicated by dashed line 47 in FIG. 3 which should be appreciated as being much larger than the actual lateral dimension of the drill bit 42. Indeed, it is practical with a bi-centered drill bit to lower it through a borehole of a smaller diameter than will be cut when the drill bit is cutting when rotated and boring into the earth or other material.

Utilizing the special geometry of a bi-centered drill bit 42, the billet 31 guides or captures the pilot portion along the path 32 while the wings 46 ream out the path as shown at 34 in FIG. 4 nearer the upper end of the billet 31. The wings 46 also drill a larger hole 21 than is drilled by end of the pilot portion 45. With the billet being drilled out, it is preferred that the billet 31 is formed of aluminum, plastic or other polymer or concrete or malleable or drillable iron or some other soft metal. Hardened steel would almost certainly tear up drill bit 42.

Figure 5:
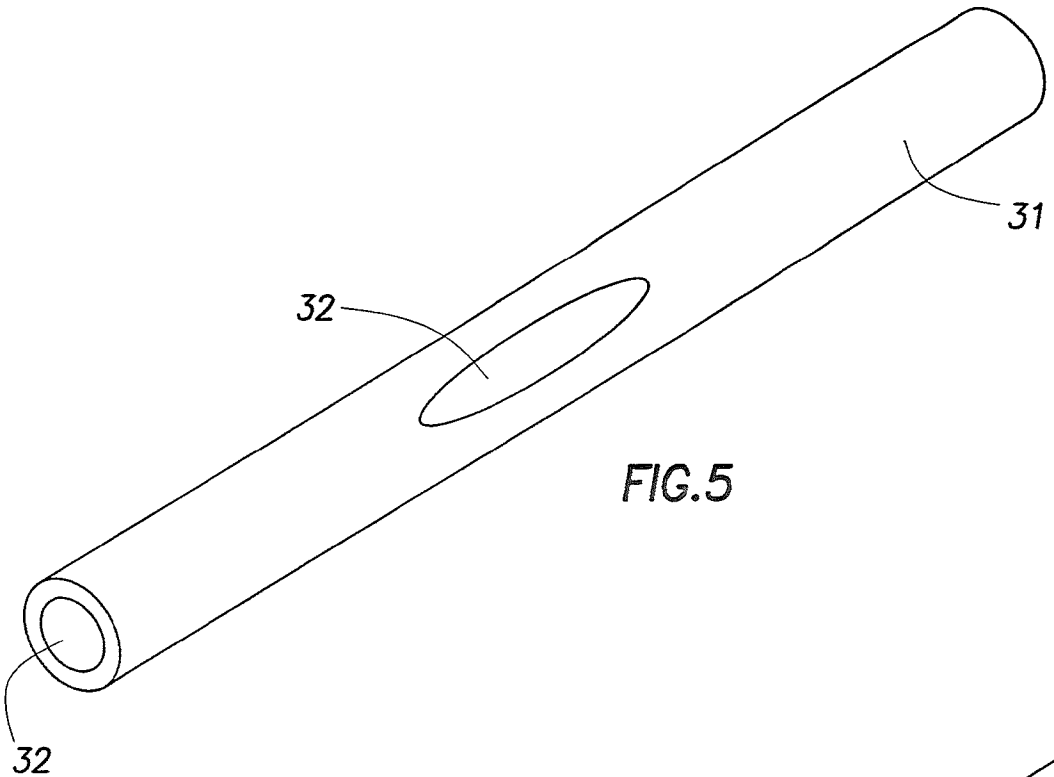
FIG. 5 is a perspective view of a billet that may be used in the present invention.
Figure 7:
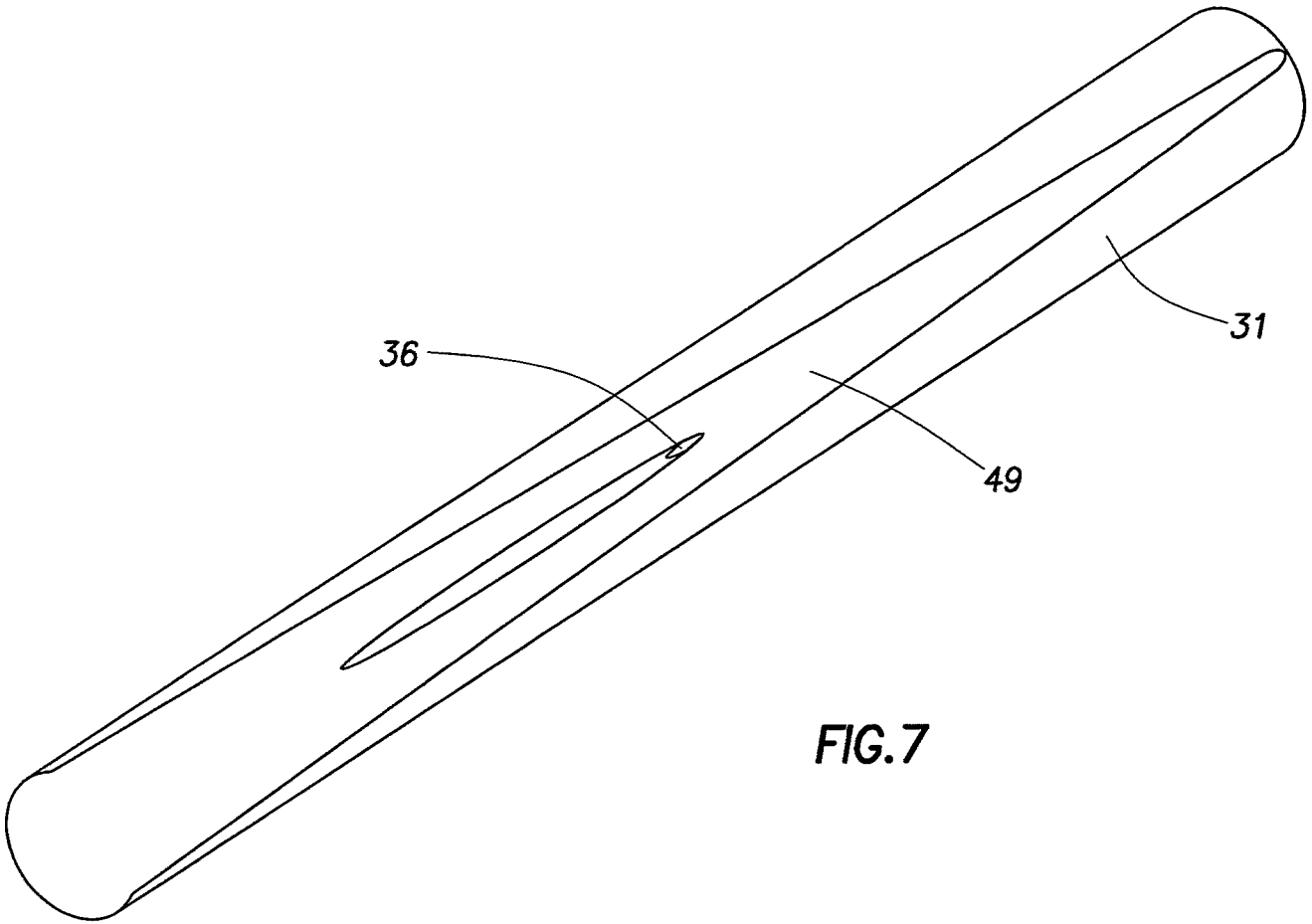
FIG. 7 is a perspective view of a billet after it has been used to drill a sidetrack wellbore.
Figure 8:
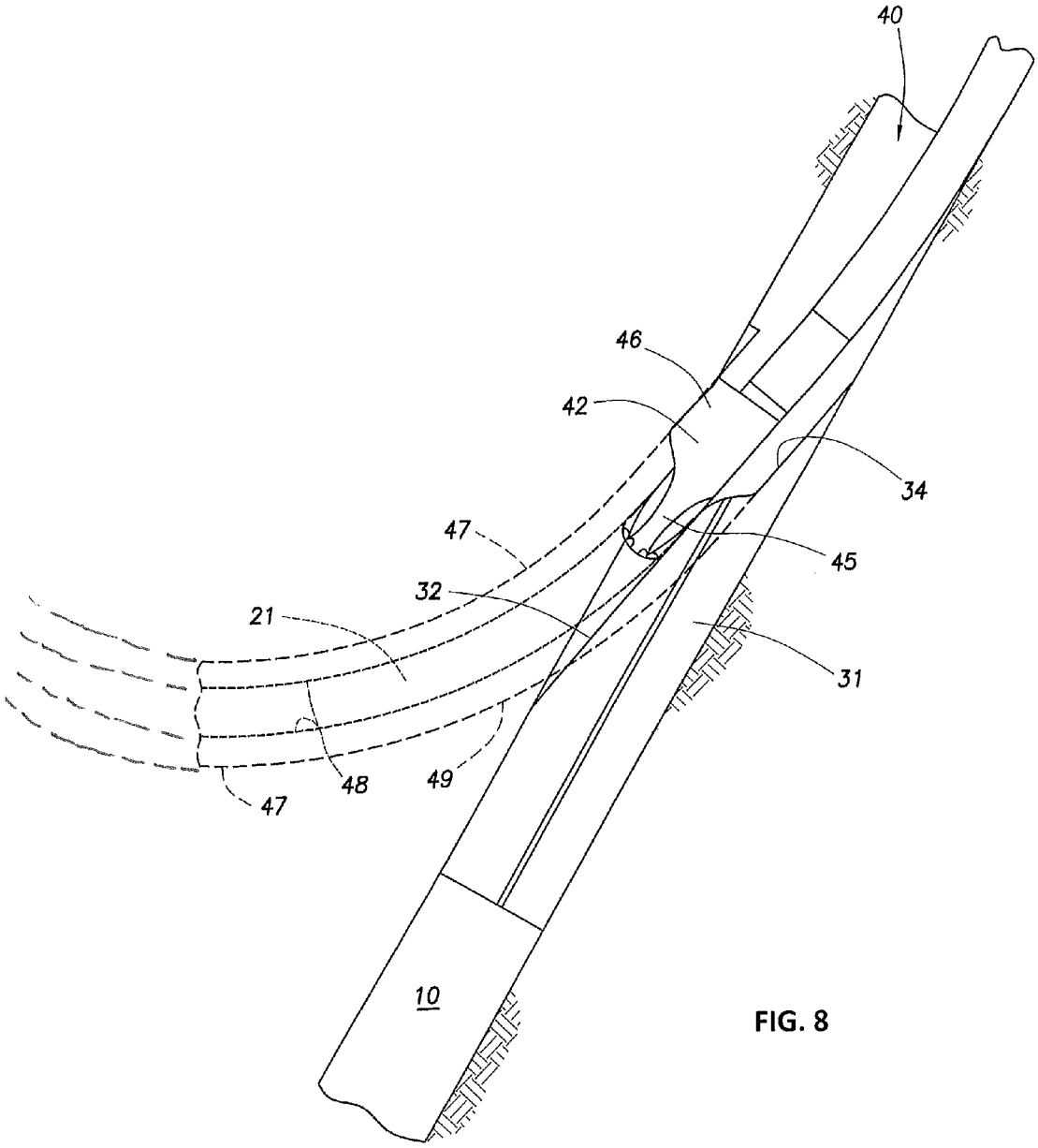
FIG. 8 is a close up vertical and fragmentary cross sectional view of a not to scale drillstring and billet in a wellbore similar to FIG. 2 with the drillbit having progressed into the sidetrack wellbore in an upward direction.

Referring now to FIG. 5, a billet 31 is shown prior to being inserted into wellbore 10. Path 32 is shown at the end nearest the top and at the peripheral side. After the bi-centered drill bit 42 has bored through the billet, a substantial amount of the billet will be cut away. FIG. 7 provides a sample of what might be expected to be left of the billet 31 after the drill bit 42 has removed a substantial portion. The upper end may be fully or nearly fully removed down to a slivered edge where the wings 46 cut into the billet while beginning to cut into the formation opposite from the remaining portion of the billet 31. As the pilot portion of the drill bit 42 followed the path 32 the entire side of the billet is removed from around the location of the peripheral exit of the path 32. Surface 49 in FIG. 7 is essentially all that remains of the billet 31 while axial channel 36 is now revealed.

Figure 6:
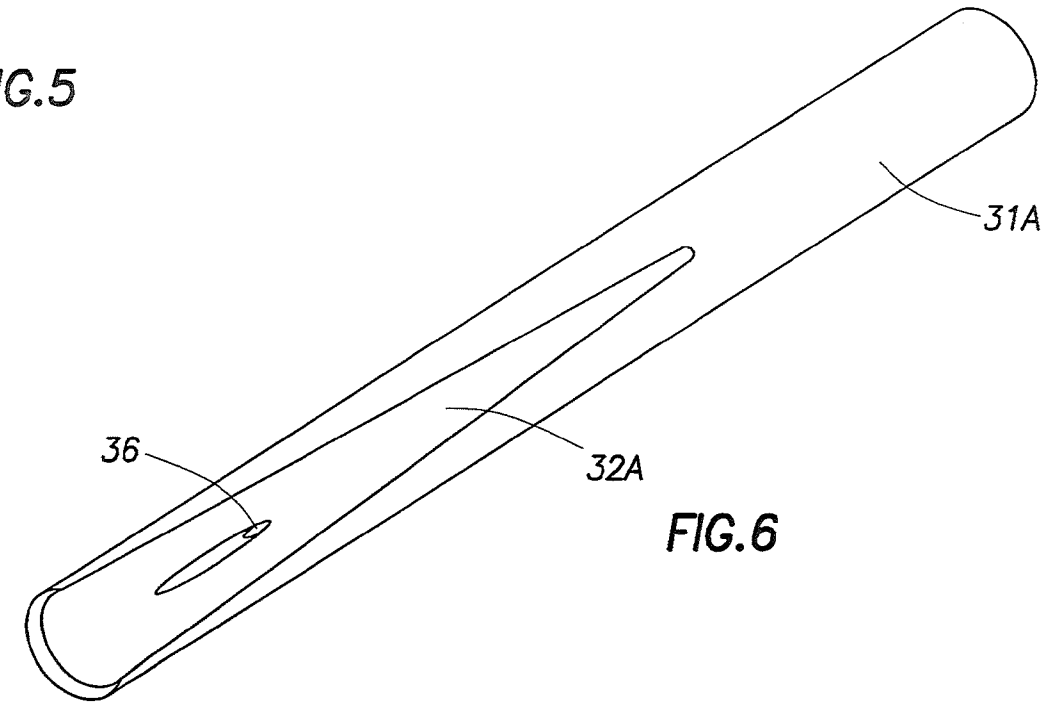
FIG. 6 is a perspective view of a billet that may be used in the present invention.

In FIG. 6, billet 31A is shown as a second embodiment of the present invention where rather than a path 32 beginning as a generally circular hole at the end, the path 32A is formed in the shape of an angled trough that extends like a ramp along the surface of the billet 31A at an angle to the axis thereof. The angled trough is deepest at the end nearest the top of the wellbore and is progressively shallower away from the end. The angled trough shaped path 32A is designed to capture the pilot portion of the bi-centered drill bit 42 and guide it while the wings 46 enlarge the path and cut substantially into the billet 31A even though the path 32A will be open at one side. Billet 31A also includes an axial channel 36 as shown. The billet 31A would likely have an appearance similar to that shown in FIG. 7 after the drill bit 42 has reamed out the angled trough path 32A.

Turning back to FIG. 2, the two lines 48 comprising short dash segments indicate the dimension of the hole that will be initially drilled by the pilot portion of drill bit 42. The two lines 47 comprising long dash segments indicate the dimension of borehole after the wings 46 have reamed out and enlarged the hole right behind the pilot portion. It should also be seen that dashed line 49 indicates the extent the wings 46 will cut into the billet 31.

It should also be recognized that the path may also be a blind pilot hole which captures the pilot portion of the drill bit so that the wings are restrained from bouncing around the borehole while the drill motor or drillstring rotates. If the motor is steerable such as by a rib steer motor, the billet may provide enough stabilizing resistance to allow the operators to direct the drill bit and drillstring in the preferred direction.

In another aspect of the invention, while fluid may pass the billet 31 through the axial channel 36, the billet 31 may be attached to liner pipe or casing at its base or be otherwise locked into place while also allowing fluids to pass through an annular space at the periphery of the billet. While in the preferred embodiment, the billet is not intended to plug the original borehole, there are circumstances where the original borehole may have entered a water zone, gas zone or unstable lost circulation zone where the portion below the billet is not intended to be further accessed Thus, having the lower portion sealed may be preferred so a billet without an axial channel or other passages would be used.

It should now be seen that a sidetrack well may be drilled out of the side of an original wellbore at a distance from the bottom thereof using a single drillstring utilizing only one trip into and out of the hole. Except for unusual circumstances such as breakdowns or other problems, the technique set forth above is designed to eliminate trips. Considerable time and costs may be saved by initiating and completing the sidetrack in one trip.

Finally, the scope of protection for this invention is not limited by the description set out above, but is only limited by the claims which follow. That scope of the invention is intended to include all equivalents of the subject matter of the claims. Each and every claim is incorporated into the specification as an embodiment of the present invention. Thus, the claims are part of the description and are a further description and are in addition to the preferred embodiments of the present invention. The discussion of any reference is not an admission that it is prior art to the present invention, especially any reference that may have a publication date after the priority date of this application.

The invention claimed is:

1. A process for drilling a sidetrack wellbore out of the side of an existing wellbore above the bottom of the existing wellbore where the process comprises:

a) installing a drillable billet into an existing wellbore at a desired location for stepping out of the existing wellbore and beginning the sidetrack wellbore, where the billet is made of a drillable material, where the billet has a long, generally cylindrical body that is suited and sized for insertion into the existing wellbore, where the billet blocks the wellbore below the location of the billet, where a path is formed in the billet, where the path is shaped as an angled trough that is arranged to direct anything descending down the wellbore to a preferred side of the wellbore;

b) lowering a drillstring with a bi-centered drill bit into the existing wellbore down to the location of the billet where the bi-centered drill bit includes a pilot drill portion suited for drilling into the earth and for following the path in the billet and at least one wing portion extending radially outwardly from the pilot drill portion suited for reaming out a hole larger than the pilot drill portion, where the diameter of the path is similar to the diameter of the pilot drill portion in order to provide stability to the drillstring as the drill bit rotates with the pilot drill portion in the path; and c) rotating the bi-centered drill bit and lowering the drillstring so as to direct the drill bit so that the pilot drill portion follows the path and the wing portion reams out at least part of the billet and also into the earth to form the sidetrack wellbore through the side wall of the existing wellbore into the earth.

2. The process according to claim 1, wherein the path in the billet is deepest at a first end of the billet closest to the top of the wellbore and is progressively shallower as the angled trough extends away from the first end where the pilot portion follows the angled trough like a ramp and is directed to drill a sidetrack wellbore out of the existing wellbore in the preferred direction.

3. The process according to claim 1, wherein the billet more particularly comprises installing a billet made of aluminum.

4. The process according to claim 1, wherein the billet more particularly comprises installing a billet made of a drillable polymer.

5. The process according to claim 1, wherein the billet more particularly comprises installing a billet made of drillable malleable iron.

6. The process according to claim 1, wherein the billet has a top end and a peripheral wall and the path begins near the center at the top end and extends straight to the peripheral wall.

7. The process according to claim 1, wherein the billet has a top end and a peripheral wall and the path is formed of a angled trough that begins at the center of the top end and extends along the peripheral wall so that the trough is deepest at the top end and is shallower as the trough extends away from the top end until the trough diminishes along the peripheral wall.

8. The process according to claim 1, wherein the billet includes an axial channel to allow fluids in the existing wellbore below the billet to flow past the billet and be produced to the surface.

9. The process according to claim 1, wherein the billet more particularly comprises installing a billet in a generally horizontal portion of the existing wellbore.

10. The process according to claim 9, wherein the billet more particularly comprises orienting the billet so that the angled wall directs the sidetrack well to one side of the existing wellbore.

11. The process according to claim 9, wherein the billet more particularly comprises orienting the billet so that the angled wall directs the sidetrack well in an upwardly direction toward a second target zone and away from the existing wellbore.

12. The process according to claim 9, wherein the billet more particularly comprises orienting the billet so that the angled wall directs the sidetrack well in an downwardly direction toward a second target zone and away from the existing wellbore.

13. A process for drilling a sidetrack wellbore out of the side of an existing wellbore above the bottom of the existing wellbore where the process comprises:

a) installing a drillable billet into an existing wellbore at a desired location for stepping out of the wellbore and beginning the sidetrack wellbore, where the billet is made of a drillable aluminum material, where the billet has a long, generally cylindrical body that is suited and sized for insertion into the existing wellbore, where the billet blocks the wellbore below the location of the billet, where the billet a path is formed in the billet, where the path is shaped as an angled trough that is arranged to direct anything descending down the wellbore to one side of the wellbore, where the path begins near the center of the billet at the end of the billet closest to the surface and progresses toward the peripheral surface of the billet as the path extends to the end furthest from the surface;

b) lowering a drillstring with a bi-centered drill bit into the existing wellbore down to the location of the billet where the bi-centered drill bit includes a pilot drill portion suited for drilling into the earth and for following the path in the billet and at least one wing portion extending radially outwardly from the pilot drill portion suited for reaming out a hole larger than the pilot drill portion, where the diameter of the path is similar to the diameter of the pilot drill portion in order to provide stability to the drillstring as the drill bit rotates with the pilot drill portion in the path; and c) rotating the bi-directional drill bit and lowering the drillstring so as to direct the drill bit so that the pilot drill portion follows the path and the wing portion reams at least part of the billet and into the earth to form the sidetrack wellbore through the side wall of the existing wellbore into the earth.

14. A process for drilling a sidetrack wellbore out of the side of an existing wellbore above the bottom of the existing wellbore where the process comprises:

a) installing a drillable billet into an existing wellbore at a desired location for stepping out of the wellbore and beginning the sidetrack wellbore, where the billet is made of a drillable material, where the billet has a long, generally cylindrical body that is suited and sized for insertion into the existing wellbore, where the billet blocks the wellbore below the location of the billet, where a blind path formed in the billet and designed and arranged to capture a pilot portion of a bi-centered drill bit descending down the wellbore, where the blind path is shaped as an angled trough;

b) lowering a drillstring with a bi-centered drill bit into the existing wellbore down to the location of the billet where the bi-centered drill bit includes a pilot drill portion suited for drilling into the earth and for insertion into the path in the billet and at least one wing portion extending radially outwardly from the pilot drill portion suited for reaming out a hole larger than the pilot drill portion, where the diameter of the path is similar to the diameter of the pilot drill portion in order to provide stability to the drillstring as the drill bit rotates with the pilot drill portion in the path; and c) rotating the bi-centered drill bit and lowering the drillstring and steering the drill bit so as to direct the drill bit to form the sidetrack wellbore through the side wall of the existing wellbore into the earth where drill bit has resistance against lands on all sides of the pilot portion while the wing portion reams out at least part of the billet and also into the earth.

* * * * *